United States Patent [19]

Pelsue

[11] 4,294,222

[45] Oct. 13, 1981

[54] PISTOL TYPE CROSSBOW

[76] Inventor: Henry F. Pelsue, 8421 Foothill Blvd., Sunland, Calif. 91040

[21] Appl. No.: 108,636

[22] Filed: Dec. 31, 1979

[51] Int. Cl.[3] ..... F41B 5/00

[52] U.S. Cl. ..... 124/25; 124/87; 124/40; 124/35 R

[58] Field of Search ..... 124/25, 40, 35 A, 87, 124/41 A, 18, 19, 22, 27, 88

[56] References Cited

U.S. PATENT DOCUMENTS

| | | | |
|---|---|---|---|
| 1,057,171 | 3/1913 | Redfield | 124/40 UX |
| 2,786,461 | 3/1957 | Pelsue | 124/25 |
| 3,167,062 | 1/1965 | Zwickey | 124/23 R |
| 3,224,427 | 12/1965 | Ronan | 124/25 |

*Primary Examiner*—Richard C. Pinkham
*Assistant Examiner*—William R. Browne
*Attorney, Agent, or Firm*—Roger A. Marrs

[57] ABSTRACT

The crossbow is disclosed herein having an elongated stock with a pistol grip handle at one end and a bow carried on the other end. The entire specific bow portion of the crossbow is movably attached to the stock by a pivot or hinge mechanism which includes a releasable latch for securing the bow in a fixed, operable position. A bow string pull-back or cocking mechanism includes a rotatable shaft having a catch at one end for selectively engaging and disengaging the bow string. Said shaft has a finger pull-back grip at its other end which includes a V-shaped portion constituting a sight for aiming of the arrow to be shot. A trigger mechanism is operably carried on the stock adjacent the pistol grip handle which includes a safety lock mechanism selectively disposed to prevent activation of the trigger mechanism when engaged therewith.

8 Claims, 8 Drawing Figures

PISTON TYPE CROSSBOW

BACKGROUND OF THE INVENTION

1. Field of the Invention

The present invention relates to the field of crossbows and more particularly, to a novel crossbow of the pistol type having a foldable bow portion and a sighting means as well as a trigger safety lock mechanism.

2. Brief Description of the Prior Art

Crossbow devices have been used in the past which have rigidly mounted a crossbow on the end of the stock which incorporates a trigger mechanism for releasing a taut bow string so as to shoot an arrow therefrom. Because the crossbow is rigidly fixed to the stock, the device is cumbersome and awkward to carry since the crossbow must of necessity be arranged substantially normal to the stock on which it is secured. Thus, the overall configuration of the device is T-shaped and the ends of the bow have a tendancy to interfere with the legs or other parts of the users body when the user is carrying or transporting the device from one place to another while holding the device in a state of readiness.

Also, difficulties have been encountered with conventional crossbow devices since trigger mechanisms are employed and seldom are safety locks used to prevent a misfire of the trigger mechanism. Also, it is difficult to aim a crossbow since the archer's or user's hand is in the way as the fingers grip the release or trigger mechanism. Even when pistol type crossbows are employed, the pull-back or cocking mechanism is generally an obstruction to the archer's or user's sighting vision.

Therefore, a long standing need has existed to provide a novel crossbow device which may be conveniently carried by the archer and which includes a suitable trigger safety guard mechanism as well as a useable sighting means for aiming the shooting of arrows.

SUMMARY OF THE INVENTION

Accordingly, the above problems and difficulties are obviated by the present invention wich provides a novel crossbow mechanism which includes an elongated stock having a pistol grip handle at one end and a bow at its opposite end. Hingeable means interconnect the mide-section of the bow with the extreme end of the stock so that the bow may be pivoted or rotated relative to the stock so as to lie parallel to the longitudinal axis of the stock. A cocking mechanism is operably carried on the stock for drawing the string of the crossbow rearwardly into a taut condition and a trigger mechanism is operably coupled to the cocking mechanism whereby the bowstring may be selectively released to fire an arrow. The cocking mechanism is rotatably carried on the stock and includes a catch which may be rotated out of interference with the bowstring when the bowstring is released for firing. A sighting means is provided on the cocking mechanism whereby the user may aim the projectile or arrow to be fired. Incorporated into the trigger mechanism is a safety catch or lock for selectively interfering with the operation of the triggering mechanism so as to avoid inadvertent firing thereof.

Therefore, it is among the primary object of the present invention to provide a novel crossbow mechanism having a foldable bow portion with respect to a stationary stock so that the bow and stock may be readily carried by a user in a convenient manner.

Another object of the present invention is to provide a novel crossbow apparatus having a trigger safety lock capable of selectively interfering with the operation of the trigger mechanism to prevent inadvertent firing of the apparatus.

Another object of the present invention is to provide a novel crossbow mechanism having a sighting means for aiming the projectile to be fired by the device.

Still a further object of the present invention is to provide a novel crossbow mechanism having the combined features of a foldable bow portion with respect to the stock and a sighting means cooperatively carried on a bowstring retraction mechanism whereby the exciting means is ready for use when the bowstring has been pulled taut.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENT

Figures 1, 2, 3:
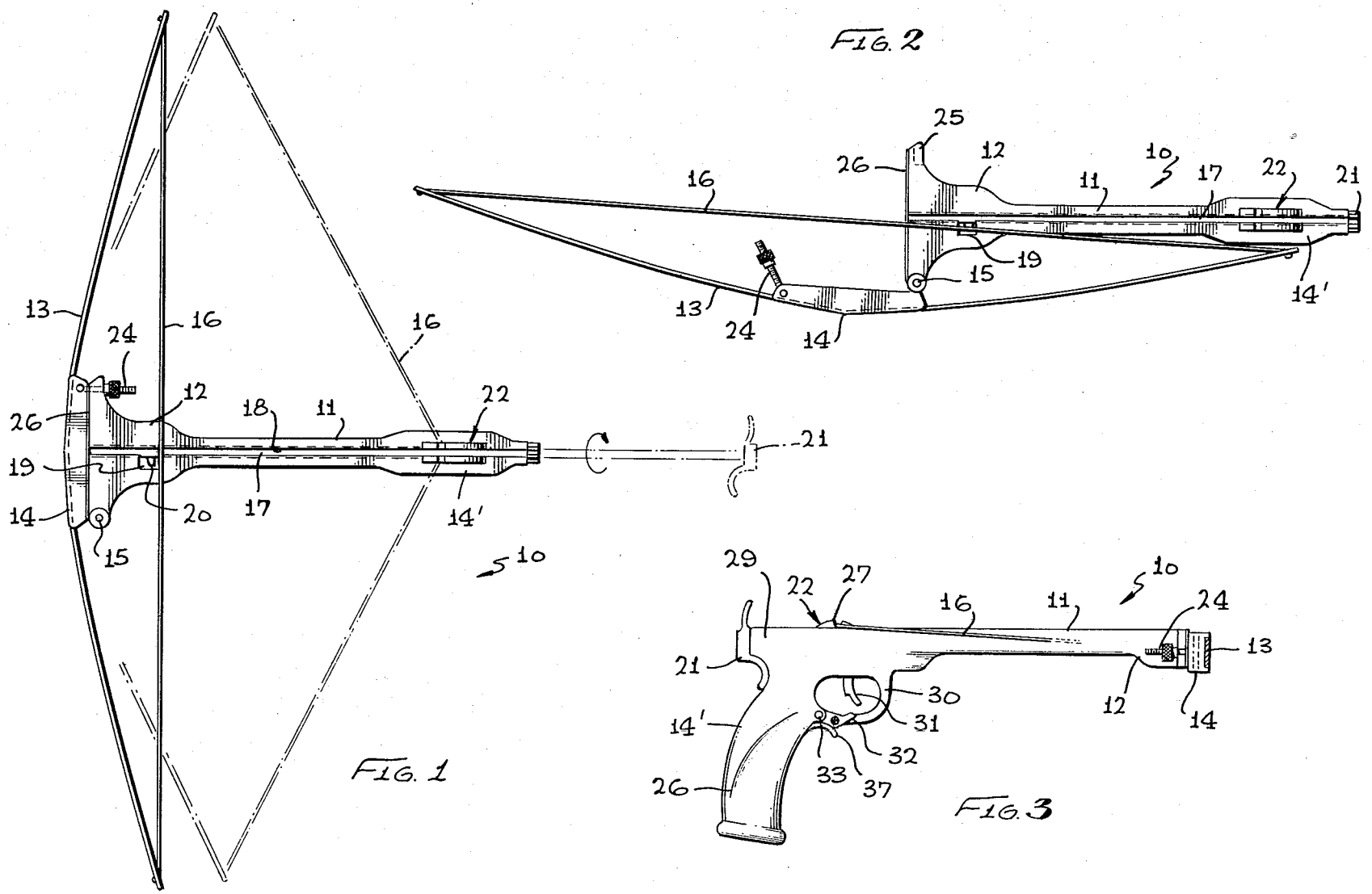
FIG. 1 is a top plan view of the novel crossbow device of the present invention.
FIG. 2 is a view similar to the view shown in FIG. 1 illustrating the bow in its folded configuration with respect to the stock.
FIG. 3 is a side-elevational view of the crossbow apparatus shown in FIG. 1.

Referring to FIG. 1, the novel crossbow apparatus of the present invention is shown in the general direction of arrow 10 which includes an elongated stock 11 having a thickened end portion 12 for mounting a bow 13 and a grip and trigger end 14'. The bow 13 is carried on the thickened end 12 by means of a support plate 14 which is movably attached to the end 12 by a hinge 15 so that the plate 14 and bow 13 will revolve or pivot about the hinge so as to lie substantially parallel to the longitudinal axis of the stock 11 substantially as shown in FIG. 2. A bowstring is carried between the opposite ends of the bow 13 and is represented by the numeral 16. As shown in broken lines, the bowstring 16 is drawn taut which pulls the opposite ends of the bow 13 inwardly towards the stock 11. Mechanism for drawing the bowstring taut includes a shaft 17 carried in a slot 18 in the stock. One end of the shaft 17 includes a catch 20 which is perpendicular to the bowstring 16 when the shaft is pulled rearwardly through the slot in the stock so that the catch engages with the mid-section of the bowstring. The catch 20 is tucked into a pocket 19 in the thickened end portion 12 when the shaft 17 is rotated in order to move the catch out of the way of the bowstring when the bowstring is released from its position shown in broken lines. The opposite end of the shaft 17 from its end carrying the catch 20 is provided with a finger grip 21 adapted to be grasped by the hand of the user when he intends to draw the bowstring into its taut or cocked position. A cocking device is illustrated in general by numeral 22 which receives the taut bowstring and holds it in position preparatory for release.

When the bowstring is in its taut or cocked position as shown in broken lines, a suitable missle such as an arrow may be placed within the groove 18 on top of the shaft 17 and the notch of the arrow may be placed into engagement with the bowstring 13. Upon loosening of the string, the missile or arrow will travel through the slot 18 and will fly from the stock from the bow end thereof.

Referring now in detail to FIG. 2, it can be seen that the bow 13 may be readily pivoted from its operational position as shown in FIG. 1 into a folded configuration wherein the length of the bow 13 lies substantially parallel to the central longitudinal axis of the stock 11. It can be seen that in order to pivot or rotate the bow on hinge 15, a latch 24 must be released from a mating fixture or closure means 25 carried on the end 12. Also, the interface of the plate 14 with the end 12 is provided with a cushion or resilient pad 26 which insures a proper seating of the plate 14 against the end 12. The seating of the plate 14 aginst the end 12 involves a substantial surface area so that the load of the strung bow will readily pass through the plate 14 into the stock 11 via the thickened end 12. When the bow is in the folded condition as shown in FIG. 2, the entire apparatus may be conveniently carried by the user in a sheath or holster which may be readily worn on the belt or other location on the user's body.

Referring now in detail to FIG. 3, it can be seen that the stock 11 is provided with a pistol grip handle 26 which is downwardly depending from the grip end 29 of the stock. It can also be seen that the cocking mechanism 22 includes a notch 27 for capturing the bowstring 16 in its taut condition. A trigger guard 30 partially encloses a trigger 31 intended to be used for releasing the cocking mechanism 22 so that the bowstring will pull from the notch 27. A safety lock means is provided by an arm 32 which is pivoted by pivot 33 to a position where it will engage with a notch 34 in the trigger 31 for preventing the trigger from being pulled backward. As shown in the drawing, the safety latch or arm 32 is part of the guard 30 and is not in its operative position for preventing movement of the trigger 31. In other words, the arm 32 is not engaged with the notch 34.

Figures 4, 5, 6, 7, 8:
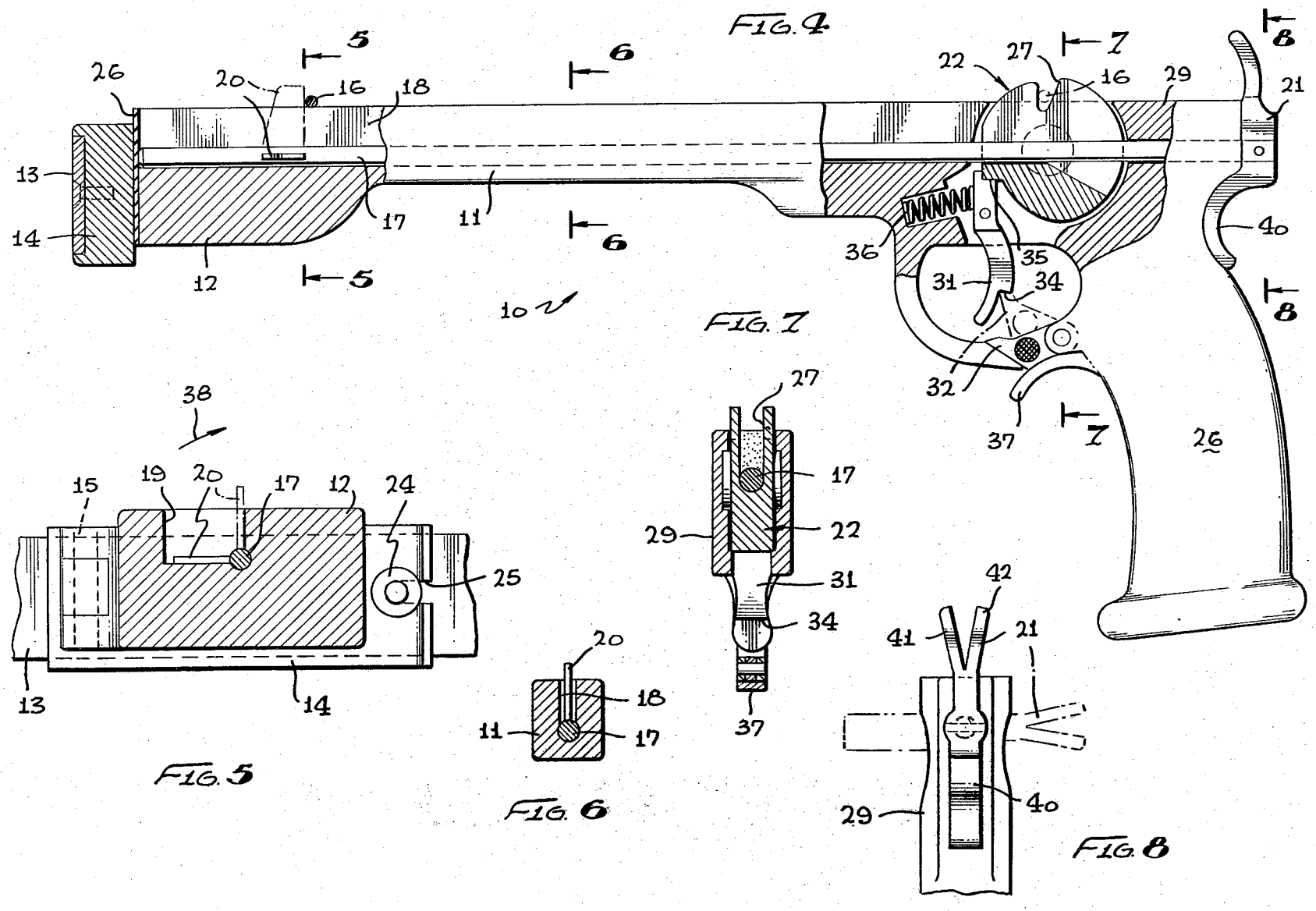
FIG. 4 is an enlarged side-elevational view, partly in section, of the crossbow apparatus illustrating the bowstring pull-back mechanism and the trigger mechanism.
FIG. 5 is a transverse cross-sectional view of the crossbow apparatus shown in FIG. 4 as taken in the direction of arrows 5—5 thereof illustrating the rotation of the bowstring catch.
FIG. 6 is a transverse cross-sectional view of the crossbow stock shown in FIG. 4 as taken in the direction of arrow 6—6 thereof.
FIG. 7 is a transverse cross-sectional view of the trigger mechanism employed in the crossbow apparatus as taken in the direction of arrows 7—7 of FIG. 4.
FIG. 8 is an end-elevational view of the sighting means as taken in the direction of arrows 8—8 of FIG. 4.

Referring now to FIG. 4, an enlarged view of the crossbow apparatus of the present invention is illustrated wherein it can be seen that the cocking and trigger mechanism is located in the end 29 of stock 11 immediately above the handle grip 26. The cocking mechanism includes a wheel 22 which presents the notch 27 in a location with respect to the top of the stock 11 so as to receive the bowstring 16 when the rod 17 is pulled rearwardly. As shown in solid lines, the notch 27 is opening upwardly and the string 16 is captured therein. The wheel 22 is prevented from rotating back to the position where the notch is shown in broken lines by engagement of the trigger 31 with a shoulder 35 in the wheel 22. A spring 36 keeps the trigger 31 in position so that the string 16 is retained within the notch 27 even though the tautness of the string 16 provides a substantial load against the wheel 22. As illustrated in broken lines, the arm or latch 32 is engaged with the free end of the trigger 31 to prevent the trigger from disengaging with the shoulder 35. This feature represents a safety lock and may be regularly manipulated by the fingers of the user's hand.

It can also be seen in FIG. 4 that the shaft 17 is readily rotated so that the catch 20 may be placed perpendicular to the string 16 so that a portion of the catch extends beyond the upper surface of stock 11. In this position, the rod 17 may be moved rearwardly drawing the catch and the string along with it. Once the string 16 has been captured within the notch 27 and the wheel 22 rotated to the extend that the trigger 31 engages with shoulder 35, the movement of rod 17 may be reversed and the rod pushed forward followed by rotation of the rod so that the catch 20 falls within the pocket formed in the thickened end portion 12. The handgrip 26 further includes a finger extension 37 which prevents the user's hand from inadvertently dislodging the latch 32.

Referring now to FIG. 5, the catch 20 is illustrated within the pocket or recess 19 in solid lines. The shaft 17 has been rotated so that the catch 20 is out of interference with the bowstring 16. However, when the shaft 17 is rotated in the direction of arrow 38, the catch 20 extends out of the pocket 19 above the top surface of the stock 11 and the terminating end portion of the catch 20 is available for engagement with the mid-section of the bowstring 16. Also, it can be seen that the latch 24 includes a bolt and knurled nut arrangement wherein the body of the bolt passes through the notch of the closure means 25 so that when the nut is rotated on the bolt threads, a secure and tight engagement insues. The pivot 15 is located on the opposite side of plate 14 and end 12 from the side carrying the latch or fastener 24 and closure means 25.

In FIG. 6, the mid-section of the stock 11 is illustrated which includes the groove 18 through which the catch 20 rides to cock the bowstring 16. The shaft 17 may not be rotated when the catch is in the mid-section of the stock so that there is no chance of the bowstring slipping from the catch during the cocking of the string.

In FIG. 7, it can be seen that the rotating catch 22 includes the notch 27 for receiving the bowstring during the cocking procedure. The shaft 17 resides within the bottom or base of the slot and rotation of the member or wheel 22 is within approximately 15 degrees. The trigger mechanism is in engagement with the shoulder of the catch member 22 and extends downwardly therefrom.

Referring now in detail to FIG. 8, it can be seen that the extreme terminating end of the shaft 17 resides in a finger catch 21 which comprises a lower portion 40 configured to be readily grasped by the fingers of the user's hand for pulling or releasing tension on the bowstring via the catch 20. However, the upper portion is identified by numerals 41 and 42 which define a V-shaped opening therebetween so as to provide a sight through which the user may aim the device. The V-shaped opening between elements 41 and 42 may be used in conjunction with the catch 20 before it is rotated into pocket 19 or without use of the catch. As illustrated in broken lines, the member 21 is rotated clockwise preparatory to immediate firing of the missile through release of the bowstring so as to remove the catch 20 from interference therewith.

In view of the foregoing, it can be seen that the crossbow apparatus of the present invention provides a novel means for reducing the overall size and awkwardness of carrying a crossbow by pivoting the crossbow 13 with respect to the stock 11 via the hinge 15 when the latch 24 has been released from the catch or closure 25. Also, a novel means is shown for retracting the bowstring into a taut condition by means of the catch 20 and the rod 17 which also includes a means for permiting the catch 20 to be pivoted out of interference with the bowstring. The trigger safety catch 32 may be readily placed in position with respect to the trigger 31 to prevent inadvertent or unwanted release of the bowstring after it has been cocked.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A crossbow comprising:

an elongated stock having a pistol grip integrally formed on one end thereof;

a flexible bow carried on the opposite end of said stock from its end having said pistol grip;

hinge means interconnecting said bow at its mid-section to said stock so that said bow has a storage position lying parallel to the longitudinal axis of said stock and an operable position lying laterally across the longitudinal axis of said stock;

latch means releasably connecting said bow to said stock adapted to secure said bow to said stock in said operable position;

said bow having a string extending between the opposite ends of said bow;

a cocking mechanism carried on said stock operable to draw said string into a taut condition;

a trigger means operably carried on said stock for releasing said bow string;

said cocking mechanism includes a rotatable rod with respect to said stock having a catch selectively engagable with said bow string for drawing said bow string taut;

said cocking mechanism further includes said stock having a longitudinal slot rotatably carrying said rod;

a finger grip carried on the rear end of said rod with said catch carried on the opposite end thereof; and a recess formed in said stock coextensive with said slot adapted to receive said catch when said rod is rotated so as to not interfere with said bow string during release of said bow string by said trigger mechanism.

2. The invention as defined in claim 1 wherein:

said trigger mechanism includes a trigger downwardly depending from a pivot connection with said stock;

a finger guard partially encircling said trigger; and a portion of said finger guard pivotally movable to engage with said trigger to prevent actuation thereof.

3. The invention as defined in claim 2 wherein:

the end of said stock carrying said bow includes a thickened portion;

a butt pad carried on said thickened portion adapted to transmit load forces into said stock;

a support plate carried on said bow mid-way between its opposite ends;

said hinge means includes a pivot connection operably coupling one end of said support plate to one end of said thickened portion whereby said support plate engages with said butt pad when said latch means is secured to retain said bow in said operable position.

4. The invention as defined in claim 3 wherein:

said catch recess is provided in said stock thickened portion; and said trigger means is releasably coupled to said cocking mechanism for selectively releasing said bow string.

5. A crossbow comprising:

an elongated stock having a pistol grip integrally formed on one end thereof;

a flexible bow carried on the opposite end of said stock from its end having said pistol grip;

hinge means interconnecting said bow at its mid-section to said stock so that said bow has a storage position lying parallel to the longitudinal axis of said stock and an operable position lying laterally across the longitudinal axis of said stock;

latch means releasably connecting said bow to said stock adapted to secure said bow to said stock in said operable position;

said bow having a string extending between the opposite ends of said bow;

a cocking mechanism carried on said stock operable to draw said string into a taut condition;

a trigger means operably carried on said stock for releasing said bow string;

said cocking mechanism includes a rod rotatably carried in a slot provided in said stock terminating in close proximity to said bow in a lateral recess;

a catch carried on a selected end of said rod adpated to enter said lateral recess so as to not interfere with said bow string; and a finger grip carried on the opposite end of said rod from its end carrying said catch.

6. The invention as defined in claim 5 including:

a safety lock mechanism carried on said stock operable to prevent operation of said trigger means.

7. The invention as defined in claim 6 wherein:

said safety lock mechanism includes a trigger guard having a pivotal portion adapted to engage with said trigger means.

8. The invention as defined in claim 7 wherein:

said finger grip constitutes a sight for aim when said rod is in a first position with said catch in said stock recess.

* * * * *